United States Patent [19]

Owen et al.

[11] 4,048,543

[45] Sept. 13, 1977

[54] DISCHARGE LAMP OPERATING CIRCUIT

[75] Inventors: Daniel V. Owen; David W. Knoble, both of East Flat Rock, N.C.

[73] Assignee: General Electric Company, New York, N.Y.

[21] Appl. No.: 729,041

[22] Filed: Oct. 4, 1976

[51] Int. Cl.[2] ..... H05B 41/231; H05B 41/30

[52] U.S. Cl. ..... 315/205; 315/206; 315/208; 315/239; 315/276; 315/283; 315/290

[58] Field of Search ..... 315/200 R, 205, 206, 315/208, 209 R, 239, 244, 246, 276, 283, 290

[56] References Cited

U.S. PATENT DOCUMENTS

| | | | |
|---|---|---|---|
| 3,628,086 | 12/1971 | Nuckolls | 315/283 X |
| 3,707,649 | 12/1972 | Kottenstette | 315/239 |
| 3,886,405 | 5/1975 | Kubo | 315/246 |
| 3,925,705 | 12/1975 | Elms et al. | 315/205 X |

*Primary Examiner*—Eugene R. La Roche

*Attorney, Agent, or Firm*—Sidney Greenberg

[57] ABSTRACT

Circuit operating from a direct current source applies DC pulses to a high pressure sodium vapor lamp to improve the color properties of the lamp. The circuit includes a controlled thyristor switch in series with the lamp, an RC timing circuit for periodically turning on the switch at predetermined intervals, and an LC circuit for turning the switch off. An inductor comprising the primary winding of a transformer in series with a diode across the capacitor of the LC circuit provides for discharge of the capacitor to enable subsequent re-charging thereof, so as to produce the desired pulsed operation of the circuit, and the transformer secondary winding in series with a diode clamps the voltage of the primary winding. The disclosed arrangement prevents excessive voltage across the controlled switch and provides for the control of lamp wattage with respect to changes in lamp voltage.

11 Claims, 6 Drawing Figures

2XVp
VSCR
V
CAPACITOR
10
Vp
VL3
Vp
Vp
VL4
IL3
IL4
TIME
t0
t1
t2
t3

DISCHARGE LAMP OPERATING CIRCUIT

The present invention relates to operating circuits for gaseous discharge lamps, and more particularly concerns direct current operating circuits for high pressure sodium vapor discharge lamps.

The present invention is an improvement on the circuits disclosed in co-pending applications of Soileau, Ser. No. 692,080 and Morais, Ser. No. 692,078, both filed June 2, 1976, and assigned to the same assignee as the present invention.

It is a general object of the invention to provide an improved DC operating circuit for pulsed operation of loads.

It is a particular object of the invention to provide an improved DC operating circuit for applying DC pulses to gaseous discharge lamps, especially of high pressure sodium vapor type, to produce improved color properties of the lamp light output.

It is another object of the invention to provide a circuit of the above type which is simple in construction, efficient and reliable in operation, and relatively low in cost.

It is still another object of the invention to provide a circuit of the above type for controlling lamp wattage in respect to changes of lamp voltage.

Other objects and advantages will become apparent from the following description and the appended claims.

With the above objects in view, the present invention in one of its aspects relates to a load operating circuit comprising in combination, a direct current power source, a first inductor, a controlled switch and a capacitor connected in series with each othe across the power source, a transformer having a primary winding connected across the capacitor and a secondary winding connected across the power source, the primary winding having a higher inductance than the first inductor, a load connected across the power source in series with the first inductor and the controlled switch, first unidirectional conducting means connected in series with the primary winding across the capacitor, second unidirectional conducting means connected in series with the secondary winding across the power source, and control means coupled to the controlled switch for repetitively operating the same at predetermined intervals, whereby DC pulses are applied to the load for operation thereof.

In a typical embodiment of the invention the load is constituted by a gaseous discharge lamp of high pressure sodium vapor type, and the controlled switch is a silicon controlled rectifier.

A related type of circuit is disclosed in co-pending application Ser. No. 750,749 — Soileau, filed Dec. 15, 1976, and assigned to the same assignee as the present invention.

The operating circuit of the invention may be used for applying DC pulses of predetermined duty cycle and repetition rate on the lamp for improving the color and other properties thereof. A method and apparatus for pulsed operation of high pressure sodium vapor lamps for improving the color rendition of such lamps are disclosed in co-pending application Ser. No. 649,900—Osteen, filed Jan. 16, 1976 and assigned to the same assignee as the present invention.

As disclosed in the Osteen application, the high pressure sodium vapor lamp typically has an elongated arc tube containing a filling of xenon at a pressure of about 30 torr as a starting gas and a charge 25 milligrams of amalgam of 25 weight percent sodium and 75 weight percent mercury.

The present invention provides an improved circuit for DC pulsed operation of such lamps in accordance with the method and principles disclosed in the co-pending Osteen application, and the disclosure thereof in that application is accordingly incorporated herein by reference. As there disclosed, pulses may be applied to the lamp having repetition rates above 500 to about 2,000 Hertz and duty cycles from 10% to 30%. By such operation, the color temperature of the lamp is readily increased and substantial improvement in color rendition is achieved without significant loss in efficacy or reduction in lamp life.

The circuit of the present invention is also useful for operating discharge lamps containing mixed metal vapors such as the above described lamp or other lamps in a manner to avoid color separation therein, in accordance with the method and principles disclosed in co-pending application Ser. No. 701,333 — Owen, filed June 30, 1976 and assigned to the same assignee as the present invention. The disclosure thereof in the said Owen application is accordingly also incorporated herein by reference.

The invention will be better understood from the following description taken in conjunction with the accompanying drawings, in which.

Figure 1:
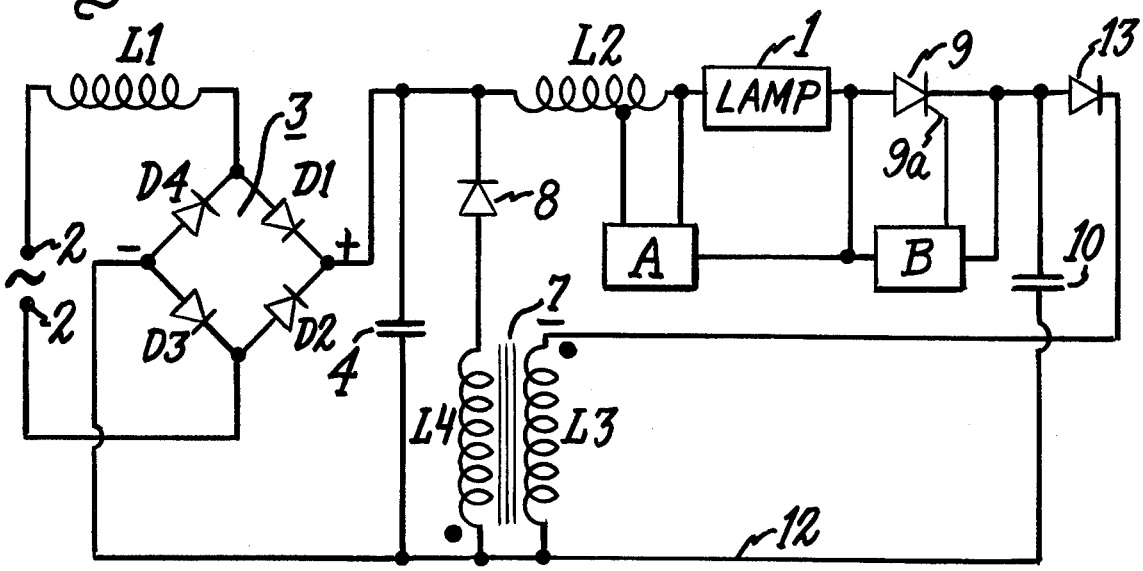
FIG. 1 is a circuit diagram of a DC pulse operating circuit in accordance with an embodiment of the invention.

Referring now to the drawings, and particularly to FIG. 1, there is shown a circuit diagram illustrating an embodiment of the DC pulsing circuit of the invention for operating a gaseous discharge lamp 1, which is typically a high pressure sodium vapor lamp such as described above. The circuit comprises terminals 2 of a source of alternating current, and induction coil L1 connected at one side to one of the source terminals and at the other side to an input terminal of full wave bridge rectifier 3, which comprises diodes D1, D2, D3 and D4 arranged in conventional manner as shown, the other input terminal of rectifier 3 being connected to the other source terminal 2. Filter capacitor 4 connected across the DC supply circuit provides a filtered DC voltage supply for the pulsing circuit described hereinafter and increases the average voltage supplied thereto. Induction coil L1 serves to limit current to the lamp at the starting and warm-up stage.

The DC pulsing circuit for lamp 1 comprises inductor L2 which is connected between the lamp and the upper terminal of filter capacitor 4. Lamp 1 is connected at its other side to series-connected controlled thyristor switch 9 such as a silicon controlled rectifier (SCR), and capacitor 10 is connected by conductor 12 to the other terminal of filter capacitor 4.

In accordance with the present invention, transformer 7 is provided in the pulsing circuit with its primary winding L3 in series with diode 13 across capacitor 10 and its secondary winding L4 in series with diode 8 across filter capacitor 4, the windings being arranged out of phase with one another as indicated in the drawing. Preferably, the transformer is characterized by low leakage reactance, that is, the windings should be tightly magnetically coupled.

Figure 2:
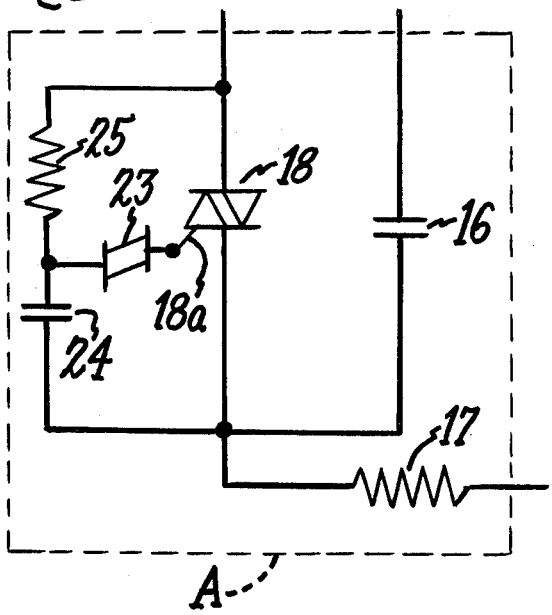
FIG. 2 is a circuit diagram of the lamp starting circuit designated A in FIG. 1.
Figure 3:
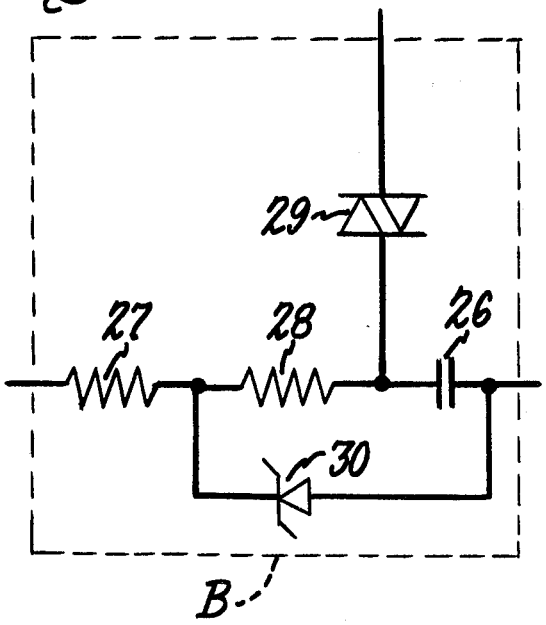
FIG. 3 is a circuit diagram of the switch control circuit designated B in FIG. 1.

The operation of SCR 9 is controlled by a timing and triggering circuit B shown in detail in FIG. 3, and a starting aid circuit A connected to inductor L2 and across lamp 1 serves to apply sufficiently high voltage pulses to lamp 1 for starting it. Starting circuit A, which is shown in detail in FIG. 2, and control circuit B are also disclosed in the aforementioned pending Morais application, and the disclosure thereof in the latter application is accordingly incorporated herein by reference. Briefly, in the operation of starting circuit A, capacitor 16 is initially charged by DC current flowing from the DC supply through inductor L2 and the circuit including capacitor 16, resistor 17, the SCR control circuit B, diode 13, and inductor L3 back to the DC supply. Capacitor 24 is charged through inductor L2 and resistor 25 until the voltage across it reaches the breakdown level of SBS 23, at which time triac 18 is triggered on. When this occurs, capacitor 16 discharges through the tapped turns of inductor L2 at its output end, including a high voltage in inductor L2 acting as an autotransformer. Pulses of this high voltage level are produced across lamp 1 by repeated charging and discharging of capacitors 16 and 24 in the described starting circuit until the lamp ignites. Upon starting of the lamp, the described high voltage ignition circuit ceases to operate as a result of the voltage clamping action of the ignited lamp load, and therefore the voltage build up across capacitor 24 does not reach the breakdown level of voltage sensitive switch 23.

The operation of the RC timing circuit shown in FIG. 3 is such that capacitor 26 is charged at a rate determined by the combination of resistors 27, 28 and capacitor 26. When the potential on capacitor 26 reaches the breakdown voltage of diac 29, capacitor 26 discharges through the loop including SCR control electrode 9a and turns on SCR 9. Zener diode 30 connected to the junction of resistors 27 and 28 of the RC timing circuit stabilizes the timing of the triggering operation by establishing a fixed clamping voltage toward which capacitor 26 is charged.

As described in the aforementioned co-pending applications, the operation of the described pulse operating circuit is such that when SCR switch 9 is triggered by the RC timing circuit, DC current flows through inductor L2, lamp 1 and SCR switch 9, thereby charging capacitor 10, which serves as an energy metering device in the circuit. The charge on capacitor 10 reaches a positive voltage substantially higher than the supply voltage, due to the voltage build up thereon as a result of the operation of the LC circuit comprising inductor L2 and capacitor 10. This causes the SCR cathode voltage to be more positive than its anode voltage, achieving commutation, i.e., turn-off, of SCR switch 9. In the absence of the shunt inductor L3, the charge would remain on capacitor 10, thereby preventing subsequent pulsing of lamp 1. In the circuit shown, capacitor 10 discharges and momentarily transfers its energy to inductor L3, subsequently this energy is returned to capacitor 10 but with the polarity of the voltage reversed, such that the upper electrode of capacitor 10 goes to a high negative potential. This negative potential is locked and stored on capacitor 10 by diode 13 and SCR 9. As a result, the voltage across SCR 9 typically assumes a positive voltage drop from anode to cathode of more than twice the supply voltage. Diode 13 is included in this LC circuit to inhibit oscillations. The next pulse is then provided by operation of the RC timing circuit, which is adjusted to trigger SCR 9 to produce pulses of the desired repetition rate for pulsing lamp 1 in the manner intended.

On subsequent cycles, the positive voltage drop across SCR 9 increases to even higher levels, until an equilibrium potential is reached as a function of the total resistive losses in the circuit. This equilibrium potential can assume values greater than twice the supply voltage. In an illustrative case, with a DC voltage of about 200 volts across capacitor 4, the equilibrium voltage across SCR 9 typically reaches about 450 volts during steady state operation. Such higher voltages, when imposed across lamp 1 during conduction of SCR 9, serve to ensure re-ionization and continued operation of the lamp, especially when the pulse repetition rate is relatively low.

The provision of transformer 7 in the circuit in accordance with the present invention serves to limit the peak voltage across SCR 9 and thereby avoids undesirable firing of the SCR, especially if it is of low voltage capability, due to excessive anode voltage. Such inadvertent firing may cause degradation of the SCR, and results in an interaction with inductor L3 to cause intermittent 60–80 ampere peak currents to go through lamp 1, which may cause lamp degradation and prevent normal ignition of the lamp.

Figure 4:
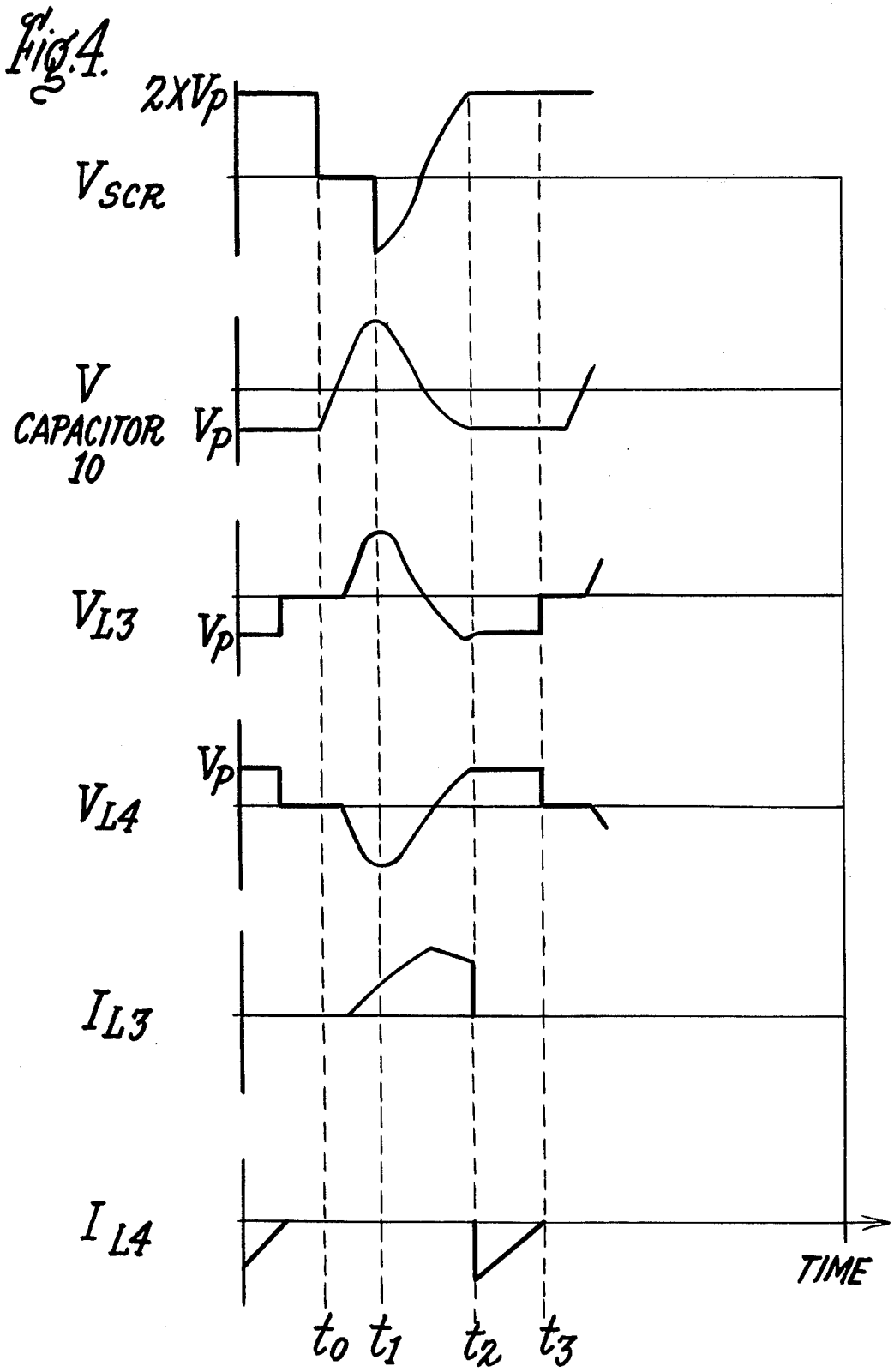
FIG. 4 shows a number of voltage and current waveforms relating to the operation of FIG. 1 circuit.

In the operation of the described circuit, and assuming the turns ratio of the transformer windings to be 1:1, when SCR 9 fires at time $t_o$ (see FIG. 4) the voltage across capacitor 10 rises to a peak value at time $t_1$. At this point SCR 9 turns off, while current has begun to flow through inductor L3. At time $t_2$ the voltage across inductor L3 (and across capacitor 10) reaches the magnitude of the power supply voltage Vp, but is of negative polarity. It will be noted that the voltage across the secondary winding L4 is identical to the voltage across primary winding L3 (insofar as the leakage reactance is negligible). When the voltage across winding L4 reaches the power supply voltage, i.e., the voltage across filter capacitor 4, diode 8 becomes forward biased and current begins to flow through L4 and diode 8 into the power supply constituted by capacitor 4, and at the same time current ceases to flow in primary winding L3. While there is a rapid change of currents in windings L3 and L4, the magnetic field in transformer 7 is continuous and not rapidly varying. The speed with which current in L3 ceases and current in L4 begins depends on the leakage reactance between the two windings. In this way, the negative voltage appearing on capacitor 10 at time $t_3$ is limited in magnitude to the supply voltage Vp, and thus the maximum voltage across SCR 9 is limited to twice the supply voltage. As a result, SCR's with a voltage rating of 600 volts can be used in place of 1000 volt SCR's, thereby effecting a substantial saving in the cost of this component. Similarly, a lower rating and less expensive diode D13 may be used.

To obtain proper operation of the described circuit, the inductance of transformer primary winding L3 must be substantially higher than the inductance of inductor L2, and preferably the inductance ratio of L3 to L2 should be at least about 10:1. The maximum inductance of winding L3 should be such, for a particular pulse frequency, that the voltage induced in secondary winding L4 exceeds the power supply voltage as described above. If the L3 inductance is too high, the time for charging capacitor 10 increases to a point where the capacitor is still being charged when the next cycle begins i.e., when SCR 9 turns on, resulting in insufficient voltage being induced in secondary winding L4 to cause conduction therein as intended.

Figure 5:
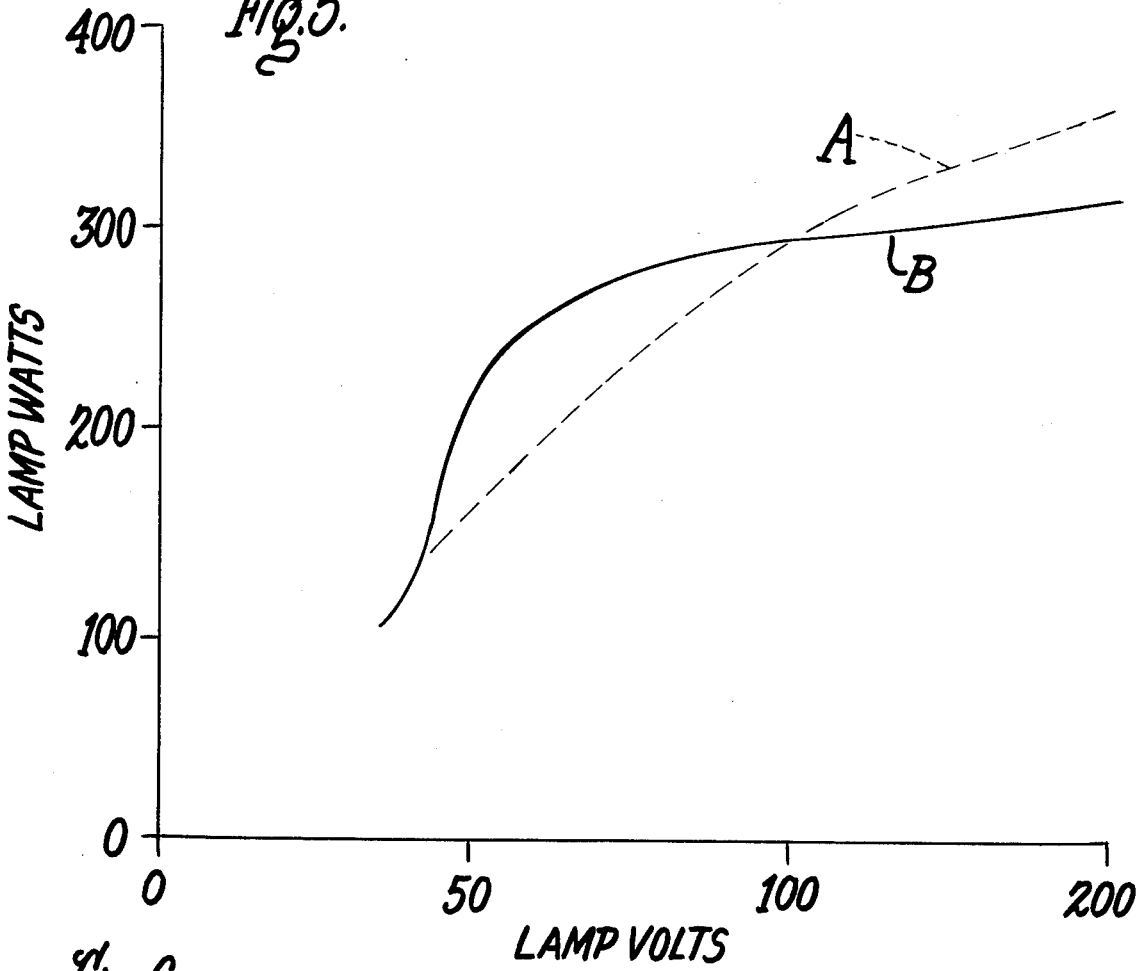
FIG. 5 is a graph showing the relationship of lamp volts and watts characterizing the circuit of the invention.

A further benefit afforded by the desired circuit is that it provides for control of the lamp watts-lamp volts relationship, whereby a flatter curve for this relationship may be obtained, as depicted in the graph of FIGURE 5. In the graph, Curve A in interrupted lines shows the variation in lamp watts with lamp volts in a circuit without the feedback arrangement of the present invention as described above, while Curve B shows the watts-volts relationship characterizing the circuit of the present invention. In the circuit of Curve A, the increase in lamp volts, which typically occurs over the operating life of lamps such as here involved, is accompanied by a substantial increase in lamp watts, which tends to shorten lamp life due to excessive heating. In contrast, it is evident that Curve B is substantially flatter than Curve A and that accordingly the lamp watts remains relatively constant with increase in lamp volts, resulting in longer life of the lamp and more nearly uniform illumination during its operating life.

The relatively steep rise at the initial portion of Curve B results from the return of energy to the power supply as described above, and typically the lamp wattage stabilizes at the top of this portion of the curve in about 1/2 minute after lamp ignition.

To obtain the benefits of the invention, the turns ratio of secondary winding L4 to primary winding L3 should be at least 1:1, and may be as high as 5:1 or higher. As will be understood, the higher the turns ratio, the higher the voltage developed across secondary winding L4 and the sooner the voltage of the latter reaches the power supply voltage and begins to conduct current to the power supply, thereby clamping the L3 voltage at some voltage lower than the power supply voltage depending on the turns ratio. Thus, the higher the turns ratio, the flatter will be the watts-volts curve.

In typical circuit in accordance with the invention, wherein the circuit has a pulse repetition rate of 1200 Hertz and a duty cycle of 20%, the tightly coupled secondary and primary windings of transformer 7 have a turns ratio of 1:1, and the inductance of the windings will be in range of 7–25 millihenries.

Figure 6:
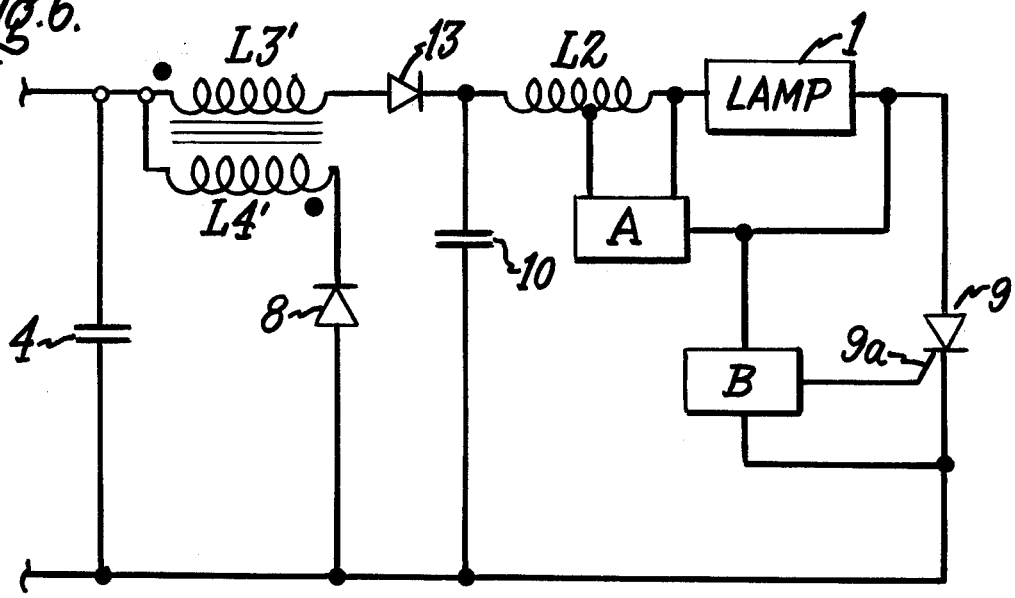
FIG. 6 is a circuit diagram of another embodiment of the invention.

FIG. 6 shows another embodiment of the invention wherein the pulsing circuit has a different arrangement from that of FIG. 1. In the FIG. 6 circuit, in which the DC supply circuit to which filter capacitor 4 is connected has been omitted for the sake of brevity, transformer *7a* comprising primary winding L3′ and secondary winding L4′ is arranged with primary winding L3′ connected in series with diode 13 across capacitor 4 and with secondary winding L4′ connected in series with diode 8 also across capacitor 4, as shown. Inductor L2, lamp 1 and controlled thyristor switch 9 are connected in series across capacitor 4. Starting aid circuit A and trigger circuit B are connected to the circuit in the manner and for the purpose described above in connection with the FIG. 1 embodiment. The FIG. 6 circuit operates in a manner substantially as described in connection with the FIG. 1 circuit, being characterized by the various waveforms shown in FIG. 4 and producing the benefits of the previously described circuit.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim and desire to secure by Letters Patent of the U.S. is:

1. A load operating circuit comprising, in combination, a direct current power source, a capacitor connected across said power source, an inductor, controlled switch means and load connecting means connected in series across said power source, a transformer having a primary winding and a secondary winding, said primary winding having a higher inductance than said inductor, first unidirectional conducting means connected in series with said primary winding across said power source, second unidirectional conducting means connected in series with said secondary winding across said power source, and control means coupled to said controlled switch means for repetitively operating the same at predetermined intervals, whereby DC pulses may be applied to the load for operation thereof.

2. A circuit as defined in claim 1, said series connected second unidirectional conducting means and said secondary winding being arranged to conduct current to said power source when the voltage on said secondary winding during operation of said transformer exceeds the voltage of said power source.

3. A circuit as defined in claim 1, said series-connected primary winding and first unidirectional conducting means being connected across said capacitor, and said series-connected inductor, controlled switch means and load connecting means being connected in series with said capacitor.

4. A circuit as defined in claim 1, said series-connected primary winding and first unidirectional conducting means being connected in series with said capacitor, and said series-connected inductor, controlled switch means and load connecting means being connected across said capacitor.

5. A circuit as defined in claim 1, said primary winding and said secondary winding being arranged so as to be out of phase with one another.

6. A circuit as defined in claim 1, said controlled switch means comprising a silicon controlled rectifier, and each of said unidirectional conducting means comprising a diode.

7. A circuit as defined in claim 1, the turns ratio of said secondary winding to said primary winding being at least 1:1.

8. A circuit as defined in claim 1, the ratio of inductance of said transformer primary winding to the inductance of said inductor being at least about 10:1.

9. A circuit as defined in claim 1, including a gaseous discharge lamp connected to said load connecting means.

10. A circuit as defined in claim 9, said gaseous discharge lamp being a high pressure sodium vapor lamp.

11. A circuit as defined in claim 9, said lamp containing mixed metal vapors.

* * * * *